United States Patent [19]

Wiener et al.

[11] 4,381,661

[45] May 3, 1983

[54] TOOL HAVING TWO WORKING JAWS

[75] Inventors: Hans Wiener, Täby; Hans Undin, Akersberga, both of Sweden

[73] Assignee: C. A. Weidmüller GmbH & Co., Detmold, Fed. Rep. of Germany

[21] Appl. No.: 131,806

[22] Filed: Mar. 19, 1980

[51] Int. Cl.[3] ..... B21D 7/06

[52] U.S. Cl. ..... 72/409; 81/5.1 R; 81/418

[58] Field of Search ..... 72/409, 410, 416, 465; 81/346, 352, 354, 355, 361–380, 381, 383, 418, 422, 421, 427, 423, 424, 5.1 R

[56] References Cited

U.S. PATENT DOCUMENTS

| | | | |
|---|---|---|---|
| 1,315,235 | 9/1919 | Olsen | 81/354 |
| 1,517,162 | 11/1924 | King | 81/354 |
| 2,814,222 | 11/1957 | Sanders | 81/423 |
| 2,910,900 | 11/1959 | Klein | 72/409 |
| 3,044,333 | 7/1962 | Broske | 81/354 |
| 3,487,524 | 1/1970 | Filia | 81/421 |
| 3,575,037 | 4/1971 | Porter | 72/409 |
| 4,199,972 | 4/1980 | Wiener | 72/409 |

FOREIGN PATENT DOCUMENTS

| | | | |
|---|---|---|---|
| 1336986 | 7/1963 | France | 81/354 |
| 20231 | 6/1910 | Norway | 72/409 |

*Primary Examiner*—Gene Crosby

*Attorney, Agent, or Firm*—Toren, McGeady and Stanger

[57] ABSTRACT

A tool particularly suitable for use in crimping includes two arm members and a pair of working jaws each supported on a different one of the arm members. A drive arrangement such as a pair of handles is connected to the arm members for moving the arm members relative to each other between open and closed positions. The drive arrangement, arm members and working jaws provide two force transmitting paths each extending between a different point on the drive arrangement where an external operating force is applied, and a different one of the working jaws whereat the operating force is transferred to an article to be worked on by the tool. At least one pivotal connection is provided, including at least one pivot member and a bearing member for engaging the pivot member. The bearing member is arranged to deform resiliently when the operating force is transferred to the bearing member by the pivot member. Preferably, at least one of the arm members is formed by two spaced apart, parallel arm plates, and a working jaw extends into the region between the plates. The plates and working jaw between them have at least two sets of aligned openings, and a retaining member which may be of resilient material is closely fitted in each set of openings to fix the working jaw to the arm member plates.

22 Claims, 14 Drawing Figures

TOOL HAVING TWO WORKING JAWS

BACKGROUND OF THE INVENTION

The present invention relates to a tool including a pair of movable arm members each of which supports a different working jaw, and a drive arrangement for moving the arm members between a closed position corresponding to closing of the jaws and an open position corresponding to opening of the jaws. Each arm member forms part of a force transmitting path extending between a point on the tool to which an external operating or supporting force is applied and a corresponding working jaw whereat the force is transferred to an article held in the jaw.

A tool constructed according to the present invention can be used for handling, e.g. gripping, or holding an article between the working jaws of the tool, or for performing an operation on the article such as crimping, pressing or cutting. The arm members of the tool can be pivoted relative to one another (tong-type tool) or move in a translatory manner relative to one another (vise-type tool), both types of tools hereinafter being referred to as a "tool of the kind specified". Tongs, pliers, clamps, vises and the like are all examples of a tool of the kind specified. The drive arrangement may include, for example, a pair of handles or a pneumatically or electrically driven actuating lever.

The term "working jaw" as used herein refers to the particular part of the tool which is adapted to perform a desired operation. Each working jaw is provided with, for example, dies, grooves, planar pressing faces or cutting edges. The term "arm member" refers to the tool part which carries or supports the working jaw, and the term "force transmitting path" which refers to those interconnected and cooperating structural parts of the tool which extend between a part to which an external force is applied, e.g., one of the tool handles, and a part which applies a force to an article, e.g., the working jaw operatively associated with the handle. Thus, the operating or supporting force applied to the tool is transferred through a force transmitting path to the article being worked on by the tool.

In the case where the drive arrangement includes a pair of handles or an actuating lever, at least one pivotal connection is provided between the arm members and/or at least one of the two handles (or the actuating lever). Each of the handles can also be pivotally connected to corresponding arm members. The connections between the handles and the arm members can also be rigid, or one handle can be pivotally connected to a corresponding arm member and the other handle rigidly connected to its corresponding arm member to define an elongated tool body.

The tool of the present invention is preferably provided with a motion control mechanism such as a ratchet-and-pawl mechanism which prevents opening of the working jaws before a working stroke of the arm members is completed.

Tools having a pair of handles and working jaws which move in a translatory manner relative to each other are known. In these tools, one working jaw may be rigidly connected to a corresponding handle and the other working jaw may be connected to the other handle through an intermediate link including two pivotal connections.

The tool constructions described above are conventional. An example of a pliers for crimping terminal ferrules onto the ends of electrical conductors wherein one handle is rigidly connected to a corresponding arm member and the other handle is pivotally connected to the other arm member, and both arm members are interconnected by an intermediate link is shown in British Pat. No. 1,522,144 of one of the present co-inventors. In some cases, e.g., when crimping terminal ferrules onto the ends of electrical conductors, and particularly when a motion control mechanism is provided, it is desirable to apply a greater working force to larger articles than to smaller ones. It will be appreciated that such a requirement may also arise for other applications of a tool of the kind specified.

One solution which has already been proposed calls for the placement of a separate resilient member in at least one of the force transmitting paths of the tool. The resilient member may be positioned, for example, between an arm member and its associated working jaw, or between an arm member and an associated member of the driving arrangement (e.g., handle) or between an arm member and an associated stationary part of the tool which supports the arm member.

An object of the present invention is to provide a tool of the kind specified wherein a resilient member is placed in a force transmitting path so that the tool construction is simplified and the use of materials such as rubber or polyurethane for the resilient member, which materials have a shorter lifetime than materials such as steel which form the remainder of the tool, can be avoided.

Another object of the present invention is to provide a method of attaching a working jaw to an associated arm member so that the tool can be constructed at lower cost.

In accordance with the present invention, a tool includes two arm members arranged for relative movement, and a pair of working jaws each supported on a different one of the arm members. A drive arrangement is connected to at least one of the arm members to move the arm members between open and closed positions in response to an externally applied operating force. The drive arrangement, the arm members and the working jaws provide two force transmitting paths each extending between a different point at which an external force is applied to the tool, and an associated working jaw whereat the external force is transferred to an article to be worked by the tool. At least one pivot member is mounted in the force transmitting path for pivotally connecting any two of the group including the working jaws, the arm members and the drive arrangement to one another. A resiliently yieldable bearing member is provided for contacting the pivot member.

In a preferred embodiment, at least one of the arm members is formed by two spaced apart, generally planar, parallel arm plates, and one of the working jaws extends into the region between the arm plates. The arm plates and the working jaw between them each have at least two sets of aligned openings at spaced apart locations therein. At least two elongated retaining members each pass through and are closely fitted in a corresponding set of the aligned openings to fix the working jaw to the arm plates.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
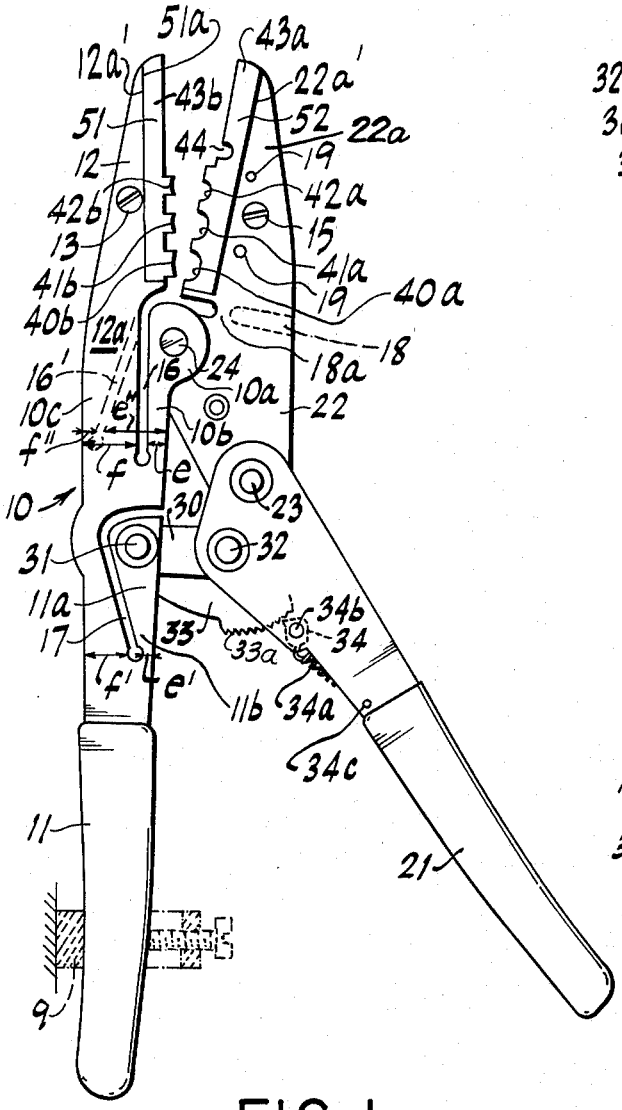
FIG. 1 is a view of a first embodiment of a tool according to the present invention including a pair of handles pivotally connected to each other by an intermediate link.

In FIG. 1, a tool body 10 is formed by a first handle 11 and a first arm member 12 which is rigidly connected to, or integral with the first handle 11. A first working jaw 51 is rigidly attached to the arm member 12 by means of a screw 13.

A second handle 21 is pivotally connected to a second arm member 22 by means of a pivot pin 23. A second working jaw 52 is rigidly attached to the second arm member 22 by means of a screw 15. The working jaws 51,52 can be interchanged with other pairs of jaws, and they are fixed to their associated arm members 12, 22 in a manner which will be described later in further detail.

Both handles 11,21 are pivotally connected to an intermediate link 30 by means of pivot pins 31,32. Arm members 12,22 are pivotally connected together by means of a pivot pin 24.

The working jaws 51,52 are provided with three mating pairs of crimping dies 40*a*,40*b*; 41*a*,41*b* and 42*a*,42*b*. A recess 44 is provided ahead of the crimping dies toward the outer end of working jaw 52 for stripping insulation from ends of electrical cables. A pair of cutting edges 43*a*,43*b* are provided at the outer ends of the working jaws as shown in FIG. 1. It is preferred that the tool be of steel construction for the most part.

A ratchet lever 33 is arranged in the vicinity of the intermediate link 30, the lever 33 having a row of teeth 33*a* arranged arcuately along an edge. A pawl 34 is pivoted on an axle stub 34*b* for engagement with the ratchet lever teeth 33*a*, and is urged toward engagement with the teeth 33*a* by a spring 34*a*. The ratchet lever 33 and the pawl 34 form the basic parts of a motion control mechanism, the detailed features of which are not part of the present invention.

Figure 2A:
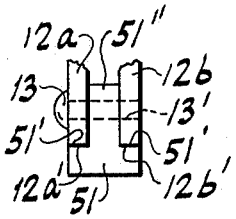
FIG. 2*a* is an enlarged, detail view of a portion of an arm member and an associated working jaw arranged on the left hand side of the tool in FIG. 1.
Figure 2B:
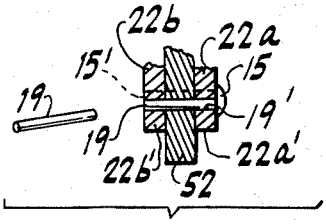
FIG. 2*b* is an enlarged, partly sectional detail view of a portion of an arm member fixed by a retaining member to an associated working jaw arranged on the right hand side of the tool in FIG. 1.

FIGS. 2*a* and 2*b* show two possible arrangements for fixing interchangeable working jaws with their respective arm members. Both of these arrangements are included on the arm members of the tool of FIG. 1 for illustrative purposes. Practically, however, only one of these arrangements is used in any one tool.

Figure 8:
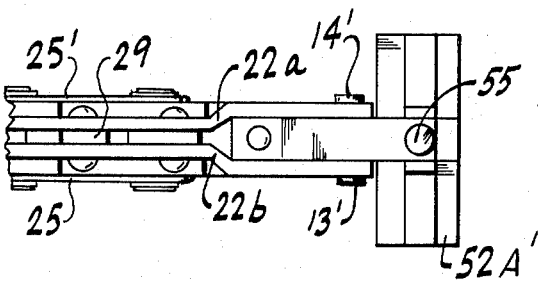
FIG. 8 is a partial edge view of the tool shown in FIG. 7.

FIG. 2*a* illustrates a conventional arrangement. The arm member 12 is formed by two spaced apart, parallel metal sheets or plates 12*a*, 12*b* which are held apart by spacing members such as 29 (FIG. 8). Edges 12*a*′,12*b*′ of the sheets or plates are precisely machined. Working jaw 51 has a T-shaped cross section with a lug 51″ extending from its rear face. Precisely machined edges 51′ on both sides of the lug 51″ are arranged to contact the edges 12*a*′, 12*b*′ of the arm member 12. A retaining screw 13 extends through an opening 13′ in both arm member plates 12*a*,12*b* and through the working jaw 51. The opening 13 is arranged a precise distance from the edges 12*a*′, 12*b*′ so that the working jaw 51 is securely fixed when it is inserted between the arm member plates 12*a*, 12*b* and secured by the screw 13.

FIG. 2*b* shows a novel arrangement including a retaining screw 15 passing through an opening 15′ which extends in arm member plates 22*a*,22*b* and working jaw 52. Also, two additional openings 19′ are each located a certain distance on opposite sides from the opening 15′, the openings 19′ extending in both arm member plates 22*a*,22*b* and in the working jaw 52. An elongated retaining element such as a bolt 19 is fitted in each of the openings 19′. For convenience, the bolt 19 may be formed of a rolled sheet of resilient material. This arrangement allows the working jaws to have cross sections other than the T-shaped cross section of the jaw 51. Further, neither the working jaw nor the arm member need have precisely machined contacting edges, and the openings 15′, 19′ need not be precisely located from the edges 22*a*′, 22*b*′ of the arm member 22. It will be understood that the elongated retaining members which pass through the aligned openings in the working jaw and the arm member may be either screws or bolts, and that two such members fitted in the openings at spaced apart locations is the minimum required number of retaining members.

Referring again to FIG. 1, an elongated slot 16 extends into the arm member 12 from an edge of the tool body 10, the slot separating a body portion 10*a* from the remainder of the tool body 10 which body portion 10*a* includes a mounting hole, i.e., bearing means for the pivot pin 24. The path of the slot through the tool body 10 is selected so that the distance e between the closed end of slot 16 and the edge of the body 10 closer to the pivot pin 24 is substantially smaller than the distance f between the end of the slot and the opposite edge of the tool body 10, so that the body portion 10*a* forms a resilient arm 10*b*.

Another elongated slot 17 extends into the handle 11 from an edge of the tool body 10 and separates a handle portion 11*a*, which includes a mounting hole, i.e., bearing means for the pivot pin 31 of the intermediate link 30, from the remainder of the handle 11 thereby forming another resilient arm 11*b*. The distance e' between the closed end of slot 17 and the edge of the handle 11 closer to the pivot pin 31 bears the same relationship to the distance f' between the closed end of the slot 17 and the opposite edge of the handle 11 as the above distances e and f bear to each other.

When the second handle 21 is operated while the first handle 11 is maintained stationary by hand or by a clamp 9 or like means, the working jaws 51,52 first close against an article to be worked by the tool, for example, a ferrule (not shown) inserted between one of the die pairs. Upon further closing movement of the handle 21, one or both of the resilient arms 10*b*, 11*b* will resiliently yield so that only upon reaching a certain degree of yield, depending upon the particular arrangement of the slots 16,17 and the parameters of the material of which the tool is constructed, further closing movement of the handle 21 will cause further movement to be transferred to the corresponding working jaw 52. Besides the desired effect obtained by providing at least one resilient member, as described above, the resilient arms 10*b*, 11*b* also provide a very smooth, soft and "resilient" feel of operation.

Referring to FIG. 1, it will be apparent that, in principle, only one of the elongated slots 16,17 is sufficient for the intended result and, further, that such a slot can be located elsewhere in a force transmitting path, for example, in the arm member 22 similarly to the slot 16 in arm member 12, or in the handle 21 similarly to the slot 17 in the handle 11.

An alternate path for the slot 16 is shown in dotted lines at 16'. The closed end of the slot 16' is located at a distance e'' from the edge of the tool body 10 closer to the pivot pin 24, and a distance f'' from the opposite edge of the tool body 10. The relationship between the distances e'' and f'' is opposite to that between the distances e and f associated with the slot 16, so that a resilient arm 10*c* is formed which connects the forward portion 12*a* of the arm member 12 through a resilient bridge at f'' with the tool body 10, the pivot pin 24 being fixed against movement relative to the tool body 10. In this case, the resilient arm 10*c* is interposed in the force transmitting path between the handle 11 and the working jaw 51, but the pivot pin 24 is not resiliently mounted. The same effect as obtained with the slot 16' may, of course, also be achieved with a slot extending in another one of the arm members or handles. For example a slot 18 having the same effect as the slot 16' may be provided, in addition to or instead of the slot 16', in the second arm member 22, so that a resilient bridge 18*a* is formed in the second arm member 22, as shown in FIG. 1.

Figure 3:
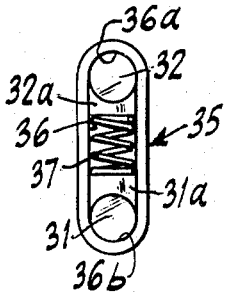
FIG. 3 is an enlarged view of a modified intermediate link which can be used in the tool in FIG. 1.

FIG. 3 shows an intermediate link 35 which is a modification of the intermediate link 30 in the tool of FIG. 1. The intermediate link 35 includes an elongated body part having an elongated slot 36 therein, the width of the slot 36 in the direction transverse of its longitudinal axis being slightly larger than the diameter of the pivot pins 31,32 which extend from the handles 11,21. Each of the pivot pins 31,32 is supported in the slot 36 by a block 31*a*,32*a*, each block having a corresponding semi-cylindrical face on one side for engaging one of the pivot pins. A coil compression spring 37 is aligned in the slot 36 with its ends exerting a spreading force on the blocks 31*a*,32*a*, thereby urging the blocks against the pivot pins 31,32. Pivot pins 31,32 are, in turn, urged against semi-cylindrical end portions 36*a*,36*b* of the slot 36.

In the event the link 35 is used in place of the link 30 of FIG. 1, all slots in the tool of FIG. 1 may be eliminated and substantially the same resilient operation of the tool will be attained as with the use of the slots in FIG. 1. Moreover, only one of the pivot pins 31,32 need be resiliently mounted in the manner shown, while the remaining pivot pin can be securely fixed in the link 35, for example, by one of the blocks 31*a*,32*a* being rigidly connected to the link 35 or formed integral therewith, or by forming the slot 36 somewhat shorter, as shown in FIG. 5.

Figure 4:
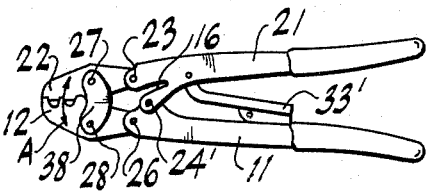
FIG. 4 is a view of a second embodiment of a tool according to the present invention, on a smaller scale.

In FIG. 4, an embodiment is shown where both handles 11,21 are pivotally connected to the respective arm members 12,22 by way of pivot pins 26,23. The arm members are pivotally connected to each other by means of an intermediate link 38 and two pivot pins 27,28. The handles 11,21 are pivotally connected to each other for relative opening and closing movement as indicated by double-headed arrow A, by way of a pivot pin 24' mounted on a resilient arm which is separated from the remainder of handle 21 by an elongated slot 16' in the handle 21. Of course, a slot such as the slot 16'' can also be provided in the other handle 11 and/or in connection with another pivot pin in a force transmitting path. The intermediate link 38 may be replaced by a link similar but not identical to the link 35. In such case, the compression spring 37 must be arranged to urge at least one of the pivot pins 27,28 in the direction toward the end of the link further from that pivot pin. A conventional motion control mechanism 33' including a straight rack is pivotally mounted between the two handles 11,21 in the tool of FIG. 4.

Figure 5:
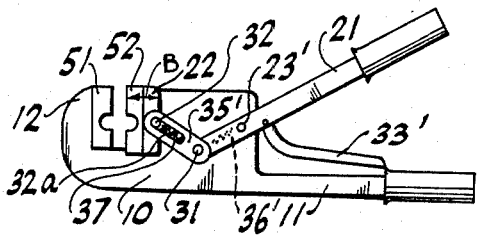
FIG. 5 is a view of a third embodiment of a tool according to the present invention.

FIG. 5 shows an embodiment wherein the arm member 22 and its corresponding working jaw 52 move in a translatory manner in both directions of the double-headed arrow B relative to the arm member 12 and working jaw 51. An intermediate link 35' is interposed between the handle 21 and the arm member 22, the pivot pin 32 fixed to the arm member 22 being resiliently connected with the link 35'. It will be appreciated that the link 35 of FIG. 3 can be used, or that either of the two pivot pins 31,32 can be arranged in a similar manner, i.e. by way of an elongated slot such as the slot 36' and a compression spring. Moreover, either one of the working jaws 51,52 may be resiliently mounted to its associated arm member 12 or 22 for relative translatory movement with the aid of, for example, two parallel guide pins and a compression spring.

Figure 6:
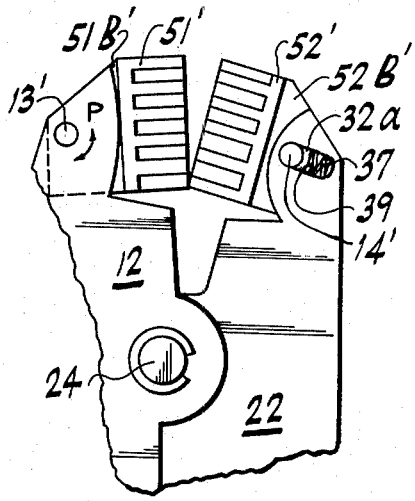
FIG. 6 is a partial view of a fourth embodiment of a tool according to the present invention, on an enlarged scale.

FIG. 6 shows the forward portion of an embodiment of a tool according to the present invention wherein working jaws 51',52' are mounted for pivotal movement in both senses of double-headed arrow P relative to corresponding arm members 12,22, by way of pivot pins 13' and 14'. Pivot pin 14' extends through an elongated slot 39 in the arm member 22, the pivot pin 14' being arranged in the slot 39 with a block 32*a* and a compression spring 37, as shown. Working jaws 51',52' have lugs 51'*b*, 52'*b* extending from their rear faces, the lugs having openings through which pivot pins 13',14' can pass.

The working jaw 51' may be arranged in the same manner as the working jaw 52'. Both the working jaws 51',52' are of a type having a number of projecting webs and are further described in U.S. Pat. No. 4,199,972 of one of the co-inventors.

Figure 7:
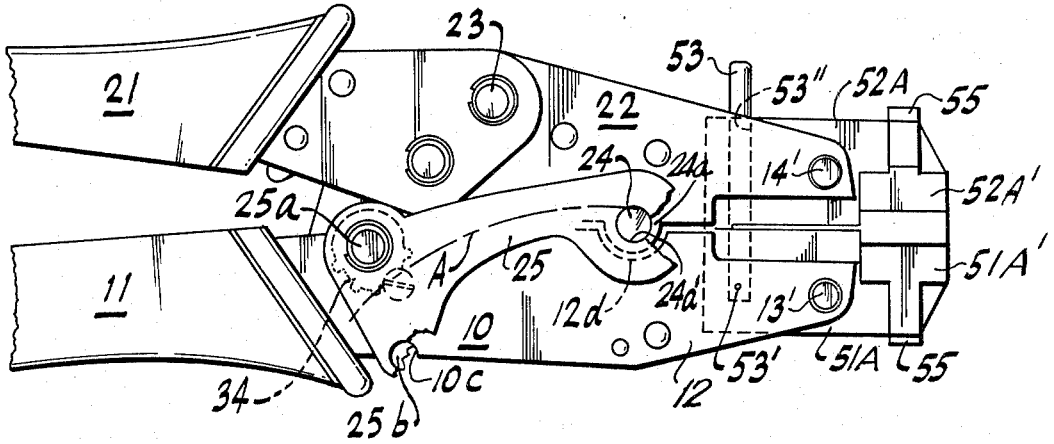
FIG. 7 is a partial view of a fifth embodiment of a tool according to the present invention.

FIGS. 7 and 8 show another embodiment of a tool according to the present invention including two separate resilient arms 25, 25' of steel each fixed against a different side of the tool body 10 by way of pins 25*a* and 25*b*. Pin 25*b* passes through a semi-circular recess 10*c* formed in the outer edge of the arm member 12. Pivot pin 24 which pivotally connects the two arm members 12,22 passes through an opening in a semi-circular protrusion 24*a* on the arm member 22, and each of the resilient arms 25, 25' has a circular hole 24*a*' at one end which faces the opening in the protrusion 24*a*. A semi-circular recess 12*d* in the arm member 12 provides clearance for the protrusion 24*a*. In accordance with this construction, the pivot pin 24 will be movable in a direction away from the edge of arm member 12 which faces the arm member 22 when an operating force is transmitted through the resilient arms 25,25'. To minimize undesired movement of the pivot pin 24 in the longitudinal direction of the tool body 10, the resilient arm 25 is preferably arcuately shaped, as represented by its longitudinal line of symmetry A. The pliers type tool shown in FIGS. 7 and 8 is of the same general type of pliers described in further detail in U.S. Pat. No. 4,048,877 or in British Pat. No. 1,500,001 of one of the co-inventors.

The working jaws 51A, 52A shown in FIGS. 7 and 8 are adapted for treating elongated articles which extend at right angles to the longitudinal direction or plane of the tool body, these jaws having operative parts 51A', 52A' which extend in this direction, as best shown in FIG. 8. The operative parts of the working jaws may be interchanged with other operative parts with the aid of mounting screws 55.

Working jaws 51A, 52A are pivotally connected to their associated arm members 12,22 by way of pivot pins 13', 14'. A guide pin 53 is fastened in the working jaw 51A by way of a fastening pin 53'. The guide pin 53 extends through and is closely fitted within a guide hole 53" in the other working jaw 52A. Accordingly, the working jaws 51A, 52A will move in a translatory and strictly parallel manner relative to each other. A very slight displacement of the jaw 52A relative to the tool body 10 will occur due to a corresponding slight arcuate displacement of the holes 24*a*' when the resilient arms 25,25' are tensioned by an operating force.

Referring to the embodiment of the present tool shown in FIG. 7, it will be understood that the arrangement of the working jaws 51A,52A including the guide pin 53 and the guide hole 53" can be advantageously used in any pliers type of tool where at least one of the working jaws is pivotally mounted. Also, more than one guide pin and guide hole can be used, as well as any other equivalent guide arrangement such as a guide rod welded to one side of one working jaw and a corresponding guide track or groove arranged on a corresponding side of the other working jaw.

Figure 13:
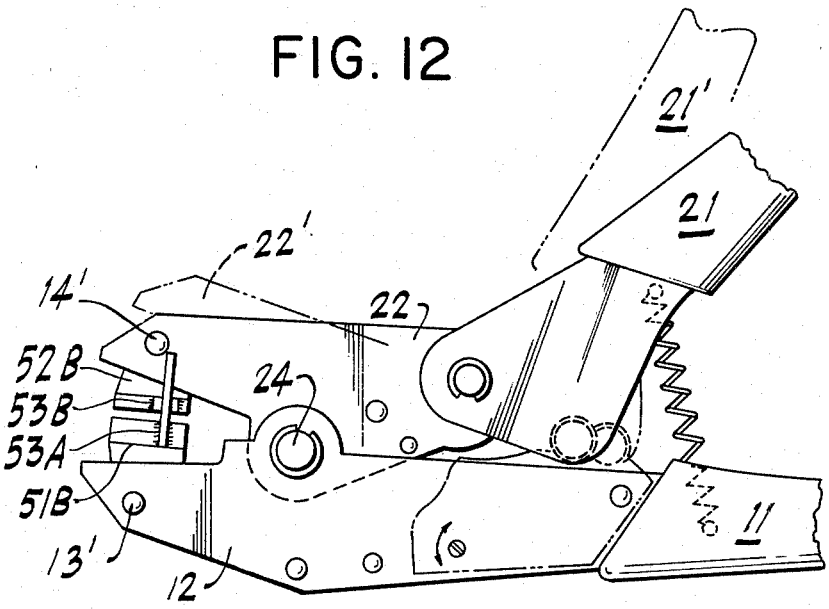
FIG. 13 is a partial view of an eighth embodiment of a tool according to the present invention.

FIG. 13 shows a pliers type of tool according to the present invention wherein working jaws 51B,52B are each pivotally mounted in a different one of the arm members 12,22 by way of pivots 13', 14'. The pivot 13',14' extend through the arm members 12,22 so that the pivot axes of the jaws 51B,52B are parallel with the pivot axis of the arm members 12,22 as defined by the pin 24. The open position of the tool is represented in dotted lines at 22'.

A guide rod 53A is welded to a side of the working jaw 51B which faces in a direction perpendicular to the direction of movement of the working jaw 51B relative to the jaw 52B. A guide trough or groove 53B is provided on the jaw 52B for guiding the rod 53A as the arm members 12,22 are pivoted relative to one another. Guide groove 53B can be formed in a member which is welded to a corresponding side of the working jaw 52B. Rod 53A is of sufficient length so that it is guided by the groove 53B even when the arm members 12,22 are opened fully.

Figure 10:
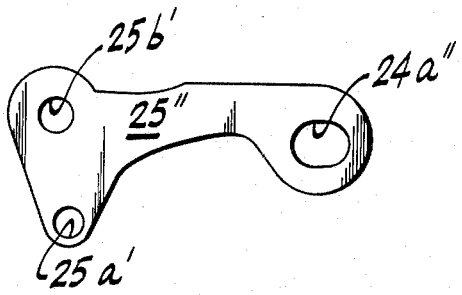
FIG. 10 is a view of a resilient arm in the tool shown in FIG. 9.
Figure 9:
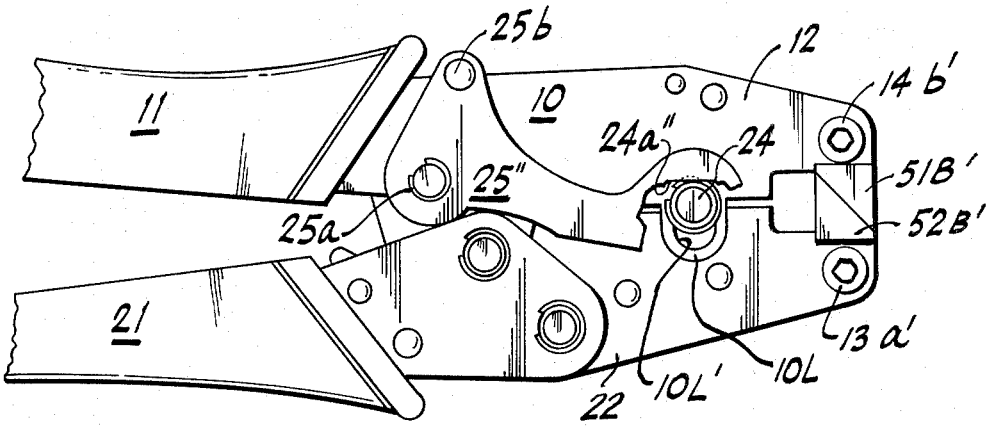
FIG. 9 is a partial view, partly broken away, of a sixth embodiment of a tool according to the present invention.

FIGS. 9 and 10 show an arrangement wherein the slight displacement of the holes 24*a*' in the resilient arms 25,25' mentioned above can be eliminated. Protrusions 10L are provided on each side of the arm member 12, each of the protrusions 10L having an elongated hole 10L' through which the pivot pin 24 can pass. The pivot pin 24 is mounted in arm member 22 in the same manner as shown in FIG. 7. An elongated hole 24*a*" is provided in resilient arm 25", the pivot pin 24 passing through the elongated hole 24*a*". The longitudinal axes of the holes 10L' and 24*a*" are substantially at right angles to each other so that the pivot pin 24 is completely stabilized relative to the longitudinal axis of the tool body. A disadvantage of this mounting arrangement, as compared with that of FIG. 7, is that the pivot pin 24 contacts the resilient arm 25" only over a somewhat limited contact area.

The working jaws 51B, 52B are of the type shown in FIG. 6 in that they include a number of projecting webs in accordance with the above-mentioned U.S. Pat. No. 4,199,972 of one of the co-inventors. However, inasmuch as the working jaws 51B', 52B' are mounted transversely of the plane of the tool body 10 of FIG. 9, their connections at 13'*a* and 14'*b* to the corresponding arm members need not be pivoted.

It will also be appreciated that in accordance with conventional constructions of a tool of the kind specified, viz., the use of two spaced apart, parallel plates or sheets such as 12*a*, 12*b* and 22*a*,22*b* forming the arm members 12,22, the two separate resilient arms 25,25' in the tool of FIGS. 7 and 8 and the separate resilient arms 25" in the tool of FIG. 9 may for each tool be replaced by a single resilient arm which is conveniently located in the region between the parallel plates or sheets of the arm members. It is also possible to provide a single resilient arm which is located against only one of the outer faces of the arm members.

Figure 11:
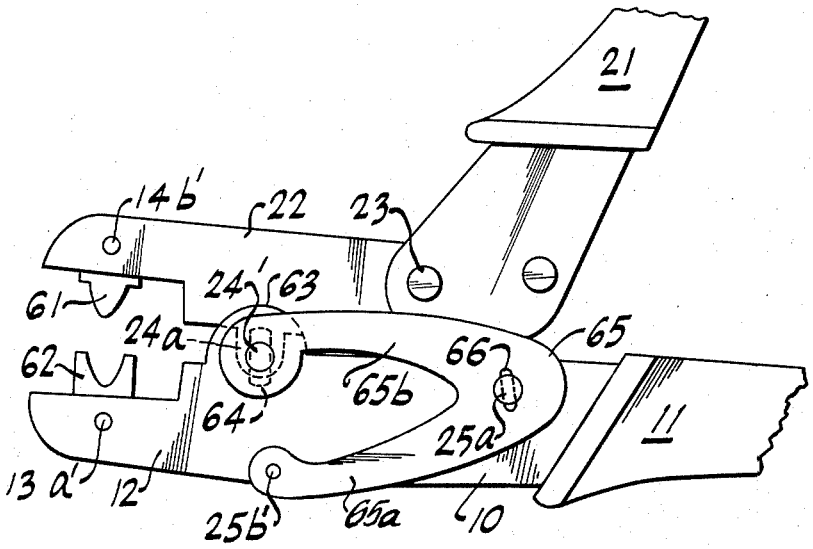
FIG. 11 is a partial view of a seventh embodiment of a tool according to the present invention.

FIG. 11 shows another embodiment of the tool according to the present invention wherein two separate resilient and generally V-shaped steel arms 65 are each fixed against a different side of the tool body 10, only one of the arms 65 being shown in the drawing. Resilient arm 65 is securely fixed at one of its ends to the outer edge of the arm member 12 by way of a pin 25*b*'. A pin 24' fixed to the other end of the resilient arm 65 passes through a hole 64 which is elongated in a direction transverse of the longitudinal axis of the tool body 10, the hole 64 being provided in a semi-circular protrusion 63 of the arm member 12. Pin 24' is also tightly fitted in an opening in a semicircular protrusion 24*a* of the arm member 22 similar to the arrangement in the embodiment shown in FIG. 7.

At the apex of the V-shaped resilient arm 65, a hole 66 is provided, the hole 66 being elongated in a direction transverse of the longitudinal axis of the tool body 10. A pin 25*a* which is fixed to the tool body 10 freely passes through the hole 66, the pin 25*a* having a head whose diameter is somewhat greater than the breadth of the opening 66.

In accordance with this construction, the effective length of the resilient arm 65 corresponds to the overall length of both legs 65*a*, 65*b* of the V-shaped arm 65. Thus, the apex or vertex of the arm 65 need not be connected with the tool body 10 on one side of the tool body 10. On the other side of the tool body 10, the opening 66 need not be elongated but may be of such dimension as to firmly embrace the pin 25*a*, and the leg 65*a* of the resilient arm 65 will nevertheless influence the resilient characteristics of the other leg 65*b* because of the inherent resilience of the material. It will also be appreciated that when two resilient arms 65 are provided, each on a different side of the tool body 10, the arm member 22 is mounted on the pin 24' in a manner similar to the arrangement of FIG. 7.

A pair of dies 61,62 defining working jaws are mounted on the arm members 12,22 in operative relationship to one another, the dies 61,62 being of a type described in detail in our co-pending patent application Ser. No. 112,192 filed Jan. 15, 1980, now U.S. Pat. No. 4,353,240.

Figure 12:
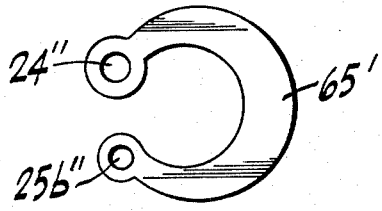
FIG. 12 is a view of a modified resilient arm which can be used in the tool of FIG. 11.

FIG. 12 shows a horseshoe or U-shaped resilient arm 65' which can be substituted for the resilient arm 65 in the tool of FIG. 11. The resilient arm 65' has an opening 24'', 25*b*'' at each of its ends for closely fitting the pins 24', 25*b* in the tool of FIG. 11, the remaining portion of the resilient arm 65' being unconnected with the tool body 10.

It will be appreciated that the intermediate links such as 30 in FIG. 1, 35 in FIG. 3, 35' in FIG. 5 and 38 in FIG. 4 can be, within the scope of the present invention, defined or replaced by a resilient arm such as arm 65 of FIG. 11, without the hole 66, or arm 65' of FIG. 12, the respective pivot pins 31, 32 or 27, 28 passing through the two openings such as 24'' and 25*b*'' at the ends of these resilient arms.

While specific embodiments of the invention have been shown and described in detail to illustrate the application of the inventive principles, it will be understood that the invention may be embodied otherwise without departing from such principles.

What is claimed is:

1. A tool comprising two arm members, two working jaws each supported on a different one of said arm members, said arm members and said working jaws supported thereon arranged for relative movement between open and closed positions, drive means connected to at least one of said arm members for imparting to said arm member a closing movement into the closed positions of said arm member and working jaws in response to an operating force applied to said drive means and transmitted along a force transmitting path to one of said working jaws, and at least one pivot means operatively and pivotally connecting one of said arm members to at least one of another said arm member and said drive means, said pivot means including a pivot member, bearing means engaging said pivot member, and resilient support means for said bearing means for allowing further relative closing movement to be transferred to said working jaws only when said support means have reached a certain degree of yield.

2. A tool according claim 1, wherein said pivot means is arranged to pivotally connect said two arm members to each other; and said support means is arranged to be resiliently yieldable relative to at least one of said arm members.

3. A tool according to claim 1, wherein said drive means includes a handle connected to each of said arm members and said pivot means comprises an intermediate link pivotally connected to each of said handles.

4. A tool according to claim 3, wherein said pivot means comprises a plurality of said pivot members, one of said pivot members is fixed to each of said handles and said intermediate link has an elongated slot therein for guiding at least one of said pivot members for movement transversely of its pivot axis, said intermediate link including a stop at one end of said slot for contacting one of said pivot members and resilient means arranged in said slot for urging said at least one of said pivot members into contact with said stop.

5. A tool according to claim 1, wherein said bearing means includes a resilient arm and said pivot member engages said resilient arm, said tool having a slot extending from an edge of said tool to separate said resilient arm from the remainder of said tool wherein said resilient arm exhibits a desired degree of resilient movement relative to the remainder of said tool when said external force is transferred through said resilient arm.

6. A tool according to claim 1, wherein at least one resilient arm is located on said tool, said tool having an elongated slot therein to form said resilient arm, said elongated slot defining a resilient bridge connected between said resilient arm and the remaining portion of said tool and said resilient arm is resiliently displaceable during the application of external force.

7. A tool according to claim 6, wherein at least one of said arm members has said elongated slot therein.

8. A tool according to claim 1, wherein at least one of said arm members comprises two spaced apart, generally planar, parallel arm plates; one of said working jaws extending into the region between said arm plates, said arm plates and said one working jaw each having at least two openings at spaced apart locations therein; and at least two elongated retaining members each passing through and closely fitted in a corresponding set of aligned openings for fixing said one working jaw to said arm plates.

9. A tool according to claim 8 wherein at least one of said elongated retaining members is formed of a rolled sheet of resilient material.

10. A tool according to claim 8, wherein at least one of said elongated retaining members is a screw.

11. A tool according to claim 1, including a pair of operating handles, and wherein said drive means comprises at least one of said operating handles.

12. A tool according to claim 11, wherein one of said arm members and said operating handles form an elongated tool body, said pivot means is arranged to pivotally connect said arm members together, and said support means includes at least one resilient arm fixed to said tool body and having an opening at one end thereof for receiving said pivot member.

13. A tool according to claim 12, wherein said at least one resilient arm is separate from said tool body, and fixing means for securing the other end of said at least one resilient arm to said tool body.

14. A tool according to claim 13, wherein said at least one resilient arm is an elongated arm which is shaped arcuately to minimize movement of the one end of said resilient arm in the elongated direction of said resilient arm when said external force is transferred through said resilient arm.

15. A tool according to claim 13, wherein said opening at said one end of said resilient arm forms a first guide slot which is elongated in the long direction of said tool body, said tool body having a second guide slot therein which is elongated in a direction substantially perpendicular to the long direction of said tool body, and said pivot member passes through said first and said second guide slots.

16. A tool according to claim 13, wherein said at least one resilient arm is generally V-shaped, the other end of said resilient arm being fixed to said tool body.

17. A tool according to claim 13, wherein said at least one resilient arm is generally horseshoe shaped.

18. A tool comprising two working jaws for grasping an object, two arm members each supporting a different one of said working jaws and arranged for relative movement between open and closed positions, drive means connected to at least one of said arm members for imparting to said arm member a closing movement into the closed positions of said arm members and working jaws in response to an operating force applied to said drive means, a tool body rigidly incorporating one of said arm members, pivot means for defining the pivotal connection of the other said arm member relative to said arm member incorporated into said tool body, said pivot means comprising a pivot member, bearing means engaging said pivot member, and support means for securing said bearing means to said tool body and defined by at least one horseshoe-shaped resilient arm provided with an opening at each of its ends, one of said openings forming said bearing means and the other said opening serving to receive a pin attached to said tool body so as to allow, when said jaw members have closed upon the treated object and the operational force continues to be applied, further closing movement to be transferred to said arm member only after said resilient arm has reached a certain degree of yield.

19. A tool according to claim 1 or 18, wherein each of said working jaws is mounted for pivotal movement relative to said arm member on which it is supported, an elongated straight rigid first guide member is firmly affixed to one of said working jaws for remaining stationary relative to said working jaw and extends in the direction toward the other one of said working jaws, a second straight guide member arranged on said other working jaw for slidably receiving and rectilinearly guiding said first guide member, said first guide member and said second guide member being dimensioned to remain in operative engagement with one another when said arm members are moved between said open and closed positions.

20. A tool according to claim 19, wherein said first guide member includes at least one guide rod and said second guide member defines at least one guide groove for engaging said guide rod.

21. A tool comprising two arm members arranged for relative movement between open and closed positions, a pair of working jaws each supported on a different one of said arm members, a drive arrangement connected to at least one of said arm members for moving the arm members between the open and closed positions in response to an external operating force supplied to said drive arrangement at a force application point thereon, said drive arrangement, said arm members and said working jaws providing two force transmitting paths each extending between a different point of application of an external force on said tool and a different one of said working jaws wherein said external force applied to the tool is transferred to an article arranged to be worked by said tool, pivot means for pivotally connecting one of said arm members to at least one of another of said arm members and said drive arrangement, said pivot means including at least one pivot member having a pivot axis, bearing means for engaging said pivot member and yieldable support means for said bearing means, one of said arm members and said drive arrangement form an elongated tool body, said pivot member is arranged to pivotally connect said arm members together, and said support means for said bearing means includes at least one resilient arm fixed to said tool body and having an opening at one end thereof for receiving said pivot member, and said at least one resilient arm is an elongated arm which is shaped arcuately to minimize movement of the other end of said resilient arm in the long direction of said resilient arm when external force is transferred to said resilient arm.

22. A tool comprising two arm members arranged for relative movement between open and closed positions, a pair of working jaws each supported on a different one of said arm members, a drive arrangement connected to at least one of said arm members for moving the arm members between the open and closed positions in response to an external operating force supplied to said drive arrangement at a force application point thereon, said drive arrangement, said arm members and said working jaws providing two force transmitting paths each extending between a different point of application of an external force on said tool and a different one of said working jaws wherein said external force applied to the tool is transferred to an article arranged to be worked by said tool, pivot means for pivotally connecting one of said arm members to at least one of another of said arm members and said drive arrangement, said pivot means including at least one pivot member having a pivot axis, bearing means for engaging said pivot member and yieldable support means for said bearing means, one of said arm members and said drive arrangement form an elongated tool body, said pivot member is arranged to pivotally connect said arm members together, and said support means for said bearing means includes at least one resilient arm fixed to said tool body and having an opening at one end thereof for receiving said pivot member, said at least one resilient arm is arcuately shaped, the other end of said resilient arm is fixed to said tool body, and said at least one resilient arm is generally horseshoe-shaped.

* * * * *